US008684479B2

(12) United States Patent
Bai et al.

(10) Patent No.: US 8,684,479 B2
(45) Date of Patent: Apr. 1, 2014

(54) REFRIGERATION UNIT HAVING A STORAGE SHELF

(75) Inventors: Yufa Bai, Anhui (CN); Lulu Huang, Anhui (CN); Wuba Lei, Anhui (CN); Alexander Rupp, Prov Jiangsu (CN)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/142,424

(22) PCT Filed: Dec. 23, 2009

(86) PCT No.: PCT/EP2009/067848

§ 371 (c)(1), (2), (4) Date: Aug. 10, 2011

(87) PCT Pub. No.: WO2010/076277

PCT Pub. Date: Jul. 8, 2010

(65) Prior Publication Data

US 2012/0126679 A1 May 24, 2012

(30) Foreign Application Priority Data

Dec. 30, 2008 (DE) ..... 10 2008 063 390

(51) Int. Cl.
*A47B 96/04* (2006.01)

(52) U.S. Cl.
USPC ..... 312/408

(58) Field of Classification Search
USPC ..... 108/27, 108; 312/401, 408, 410, 351, 312/140.4; 211/153
See application file for complete search history.

(56) References Cited

U.S. PATENT DOCUMENTS

| | | | | |
|---|---|---|---|---|
| 3,102,499 | A * | 9/1963 | Shelor | 108/28 |
| 3,637,085 | A | 1/1972 | Ball | |
| 4,373,448 | A * | 2/1983 | Pallotta | 108/29 |
| 4,736,997 | A | 4/1988 | Besore et al. | |
| 4,934,541 | A | 6/1990 | Bussan et al. | |
| 4,960,308 | A | 10/1990 | Donaghy | |
| 5,332,611 | A * | 7/1994 | Shanok et al. | 428/122 |
| 5,499,886 | A * | 3/1996 | Short et al. | 403/381 |
| 6,105,233 | A * | 8/2000 | Neal | 29/451 |
| 6,135,581 | A * | 10/2000 | Kopp et al. | 312/140.3 |
| 6,378,831 | B1 * | 4/2002 | Copeland, Jr. | 248/345.1 |

(Continued)

FOREIGN PATENT DOCUMENTS

| | | | |
|---|---|---|---|
| DE | 4038172 | A1 | 6/1992 |
| EP | 0685695 | B1 | 10/1997 |
| EP | 0856712 | A2 | 8/1998 |
| KR | 20020051135 | A | 6/2002 |
| WO | 2008135430 | A1 | 11/2008 |

OTHER PUBLICATIONS

National Search Report DE 10 2008 063 390.9, Mar. 23, 2012.
International Search Report PCT/EP2009/067848, Apr. 11, 2011.

*Primary Examiner* — Matthew Ing
(74) *Attorney, Agent, or Firm* — Nixon & Vanderhye P.C.

(57) ABSTRACT

A refrigeration device, in particular a household refrigerator, includes at least one internal container having at least one storage shelf. An edge strip or framing element is attached along at least one edge portion of the storage shelf. Seated on the edge strip or framing element of the storage shelf along part of or all of its longitudinal extent is at least one outer profiled strip and connected by at least one snap connection, plug-in connection and/or clamp connection.

39 Claims, 9 Drawing Sheets

(56) References Cited

U.S. PATENT DOCUMENTS 6,412,739 B1 7/2002 Smith
7,147,293 B2 * 12/2006 Bienick et al. ..... 312/408
7,300,121 B2 * 11/2007 Diebold et al. ..... 312/408
7,383,627 B1 * 6/2008 Kinnard et al. ..... 29/717
7,410,230 B2 * 8/2008 Anderson et al. ..... 312/407

* cited by examiner

REFRIGERATION UNIT HAVING A STORAGE SHELF

BACKGROUND OF THE INVENTION

The invention relates to a refrigeration device, in particular a domestic refrigerator, having one or more storage shelves in its at least one internal container, wherein an edge strip or framing element is attached along at least one edge portion of the respective storage shelf.

Cooling or refrigeration devices, in particular refrigerator and/or freezer cabinets in the domestic appliance sector, have an internal container having at least one interior space which can be closed by means of a door. So that the receiving capacity of the interior space serving as the refrigeration space can be better utilized, the cooling space is divided into a plurality of compartments. This is typically done with the aid of storage shelves which with the aid of corresponding mounting elements are mounted horizontally on the side walls of the cooling space. To enable the number and arrangement of the individual compartments to be adapted on an individual basis, in this arrangement the storage shelves are mounted detachably on the side walls of the cooling space. Storage shelves used are, among other options, glass panels surrounded by edge strips. For these, edge strips which are joined by adhesion or indeed are injection molded into place may be used. In this arrangement, the front edge strip may also include a gripping structure for withdrawing the respective storage shelf from its anchored position, as is the case for example in the storage shelf of EP 0 856 712 A2.

Patent specification U.S. Pat. No. 4,960,308 discloses a refrigerator cabinet having a plurality of storage shelves. The storage shelves include a glass panel which is inserted loosely condition in a flange in a plastic frame.

Published application KR 2002 00 511 35 discloses a cover for a container.

Patent specification U.S. Pat. No. 4,736,997 discloses a refrigerator cabinet having an interior space in which a plurality of storage shelves is inserted.

Published application EP 0 685 695 A 1 discloses a refrigerator cabinet having at least one shelf, arranged in the interior space thereof, for the setting down of refrigerated goods. The shelf includes a setting-down surface inserted in a frame. The frame has an integrated gripping part.

Published application DE 10 2007 021 569 A1 discloses a refrigerated product carrier having a frame which is at least partly formed by an extruded profile.

BRIEF SUMMARY OF THE INVENTION

It is the object of the invention to provide a refrigeration device, in particular a household refrigerator, which has at least one storage shelf whereof the appearance may be varied or redesigned in a simple manner.

This object is achieved in the case of a refrigeration device, in particular a household refrigerator, of the type mentioned at the outset, in that in addition at least one outer profiled strip is seated on the edge strip or framing element of the respective storage shelf along part of or all of its longitudinal extent by at least one snap-on, push-on and/or clamping connection. This means that the respective storage shelf can be provided with a desired profiled strip simply and flexibly. As a result, the same basic model of storage shelf may be adapted to different conditions, in particular for different models and designs of refrigeration devices. This is because the visual appearance of the respective storage shelf can be varied in a simple manner by changing or replacing the profiled strip. For example, the respective storage shelf can be adapted to the design or interior of the respective refrigeration device by mounting a profiled strip having a different geometric shape and/or different material to the edge strip or framing element of the respective storage shelf, along part or all of its length by at least one snap-on, push-on and/or clamping connection.

The refrigeration device has at least one internal container and at least one storage shelf which may be mounted in at least one interior space of the internal container. In this case, according to an advantageous further development of the invention, the storage shelf includes a shelf element and a profiled strip which may be mounted on the shelf element and has an upper and a lower limb. According to another advantageous further development of the invention, the shelf element in particular further has a panel and an edge strip which at least partly surrounds this panel, wherein at least on one of the two sides of the edge strip at least one shouldered edge is provided which, in the mounted condition of the profiled strip, cooperates with a projection arranged on the limb that is associated with the respective side such that the respective projection reaches behind the shouldered edge and consequently makes a form-fitting connection between the profiled strip and the shelf element. This specific type of fastening makes it possible advantageously to mount the profiled strip simply by sliding it laterally. In this case, advantageously the fastening is constructed to be reversible, that is to say may be detached again. In particular, the profiled strip may be dismantled again by being withdrawn laterally and may be replaced for example by another profiled strip.

A further advantageous embodiment of the invention provides for the shouldered edge to take the form of a groove which in the mounted condition of the profiled strip receives an associated projection. A groove may be formed in a particularly simple manner for example as a milling, or as a ridge made by the injection molding method. Further, optimum fastening of the projection may be achieved with the aid of a groove which is adapted to the profile of the projection.

In a further advantageous embodiment, the groove serves as a guide for the associated projection. In this arrangement, the profiled strip may in particular be constructed such that it may be mounted on the shelf element by being slid laterally. The groove allows better guidance to be achieved and hence mounting of the profiled strip on the shelf element to be simplified.

In a further advantageous embodiment of the invention, the projection takes the form of a latching element which causes the limbs of the profiled element to spread when the profiled strip is mounted on the shelf element and comes into snap-on engagement with the shouldered edge when a limit position is reached. A latching connection enables mounting of the profiled strip to be particularly simple and quick. Further, this enables unintentional dismantling of the profiled strip to be prevented in an effective manner.

According to a further advantageous embodiment of the invention, it is provided for the two limbs to extend substantially parallel to one another and to form a holding region of the profiled strip adjacent to a profiled region of the profiled strip, wherein the profiled region includes a profile structure in the form of a grip and/or a face plate. The fact that the two limbs extend parallel makes it easier to mount the profiled strip. Providing different profile structures allows the profiled strip and hence the storage shelf to be adapted on an individual basis.

In a further advantageous embodiment, it is provided for the profile structure to take the form of a lug having a substantially triangular profile. A gripping structure can be formed in a simple manner with the aid of this profile.

In a further advantageous embodiment, the lug has a substantially triangular aperture extending along the profiled strip. The aperture is suitable for reducing the material and/or weight of the profiled strip.

In a further advantageous embodiment, the lug is formed offset downwards in relation to the limbs. This allows a gripping structure with improved handling and feel to be made, since the offset makes it possible to reach behind the profile structure with the index finger, middle finger, ring finger and/or little finger.

A further advantageous embodiment of the invention provides for the panel to take the form of a glass panel. Glass panels make it possible to have a clearer view of the refrigerated goods arranged under them in the refrigeration space.

According to a further advantageous embodiment of the invention, the panel has a shouldered edge which in the mounted condition of the profiled strip cooperates with a projection arranged on one of the limbs of the profiled strip such that the respective projection reaches behind this shouldered edge to make a form-fitting connection between the profiled strip and the panel. This has the effect of fastening and/or guiding the profiled strip, in addition to or independently of the edge strip. Further, the panel may be fixed inside a frame formed by the edge strip.

In a further advantageous embodiment, the edge strip takes the form of an injection molded strip at least partly surrounding the panel. This constitutes a particularly simple way of manufacturing the shelf element. Further, it makes it possible to frame the glass panel with a particularly close fit, which makes it easier to clean the shelf panel, for example.

A further advantageous embodiment of the invention provides for the edge strip to include one or more holding elements which serve to mount the storage shelf on the side walls. The holding elements make it possible or easier to mount the storage shelf inside the refrigeration space. These structures may be manufactured particularly simply if the edge strip is manufactured by an injection molding method.

The invention also relates to a storage shelf for a refrigeration device constructed according to the invention, in particular a domestic refrigerator.

Other further developments of the invention are reproduced in the subclaims.

BRIEF DESCRIPTION OF THE DRAWINGS

The invention and its further developments will be explained in more detail below with reference to drawings.

In the drawings, in each case in schematic form.

DETAILED DESCRIPTION OF EXEMPLARY EMBODIMENTS OF THE PRESENT INVENTION

Figure 1:
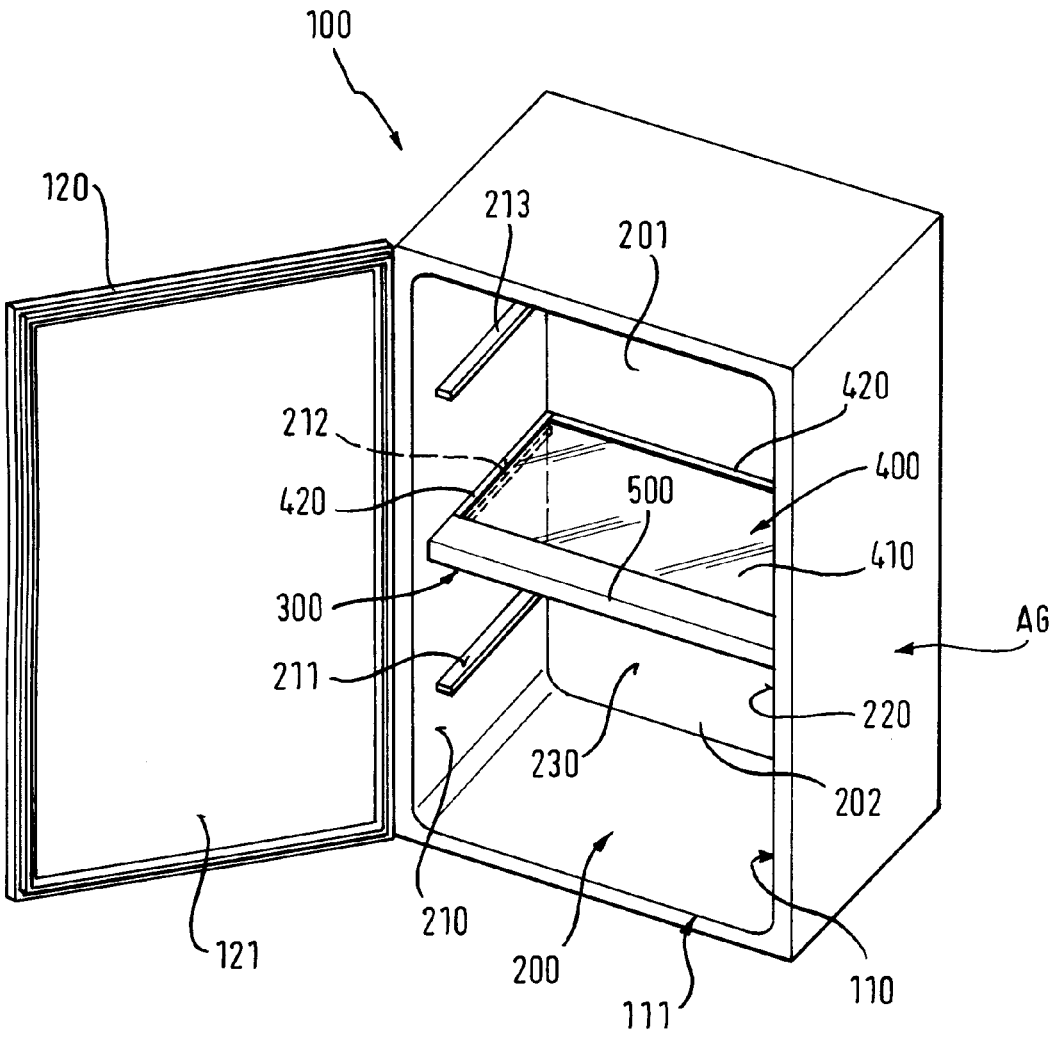
FIG. 1 shows a domestic refrigerator having a storage shelf mounted in a cooling space, according to the invention.

Elements having a like function and effect are in each case given the same reference numerals in FIGS. 1 to 18.

FIG. 1 shows an advantageous exemplary embodiment of a refrigeration device or cooling unit 100 according to the invention. The cooling unit 100 has an internal container 110 which is constructed in the form of a box and has a thermally insulating jacket (not visible here in FIG. 1, since it is an internal intermediate layer) and an external housing AG. The external housing has four external walls, a unit floor and an upper wall. Inside the internal container 110 there is formed an interior space 200 which is accessible by way of an opening 111 arranged at the front. The interior space 200 which serves as the cooling space may be closed at its end face by means of a thermally insulated door 120, and is delimited by two side walls 210, 220, a rear wall 230, a base wall and an upper wall and, when the door 120 is closed, by the inner wall 121 of the door 120. To divide the horizontally loadable cooling space 200, storage shelves 300 may be mounted on the walls 210, 220, 230. These storage shelves 300 are typically mounted detachably in the interior space 200 by way of one or more holding elements, such as bearing surfaces 211, 212, 213 which project out of the side walls 210, 220 or are formed therein. In FIG. 1, for the sake of simplicity in the drawing, only a single storage shelf 300 is shown, mounted in a central position. In this case, the storage shelf 300 includes a shelf element 400 and a profiled strip 500 mounted on the end face of the shelf element 400. The shelf element 400 in turn includes a shelf panel 410 and an edge strip 420 which surrounds the outer periphery thereof, running around the latter. The shelf panel 410 preferably takes the form of a glass panel.

In the present case, the profiled strip 500 takes the form of a gripping strip for withdrawing the storage shelf 300 from the interior space 200 of the refrigeration device 100. The function and form of the gripping strip may vary depending on the application. Thus, the profiled strip 500 may for example also take the form of a face plate or decorative strip.

Figure 2:
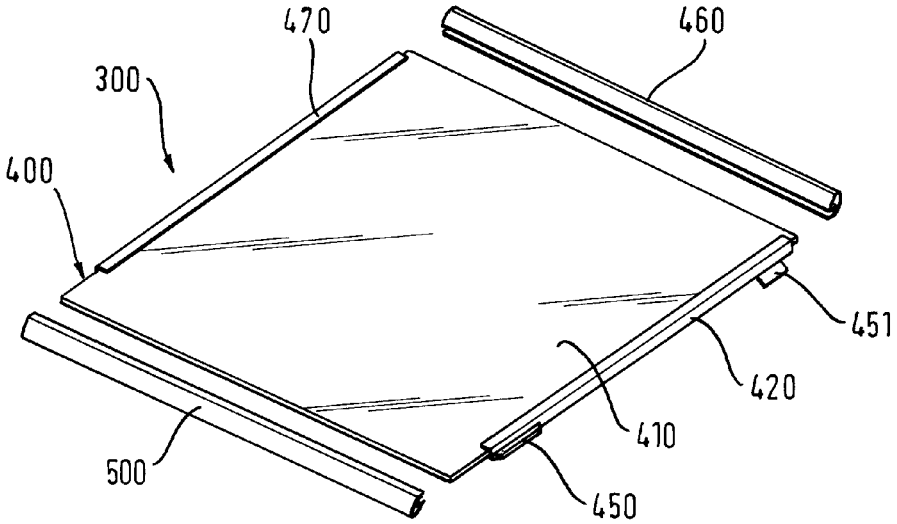
FIG. 2 shows a storage shelf according to the prior art.

FIG. 2 shows a conventional storage shelf 300 for mounting in an interior space 200 of a refrigeration device 100. In this arrangement, the storage shelf 300 includes a shelf element 400 and two strips 460, 500 which may be attached to the shelf element 400. The shelf element 400 in turn includes a substantially rectangular panel 410 and two edge strips 450, 470 which are fastened to the panel, extend depthwise and have corresponding holding elements 450, 451 for mounting the storage shelf in the interior space 200 of the refrigeration device 100. The strip 500 on the front face takes the form of an edge strip with a gripping structure. Here, the rear strip 460, which faces the rear wall 230 of the interior space 200 in the mounted condition, also takes the form of an edge strip, and serves as a spacer to keep stored refrigerated goods away from the rear wall. Both edge strips 500, 460—like the two side edge strips 450, 470 extending depthwise—take the form of a clip and are pushed directly onto the edges of the panel 410. Typically, the edge strips 420, 460, 470, 500 are fastened to the panel 410 with the aid of an adhesive.

Figure 3:
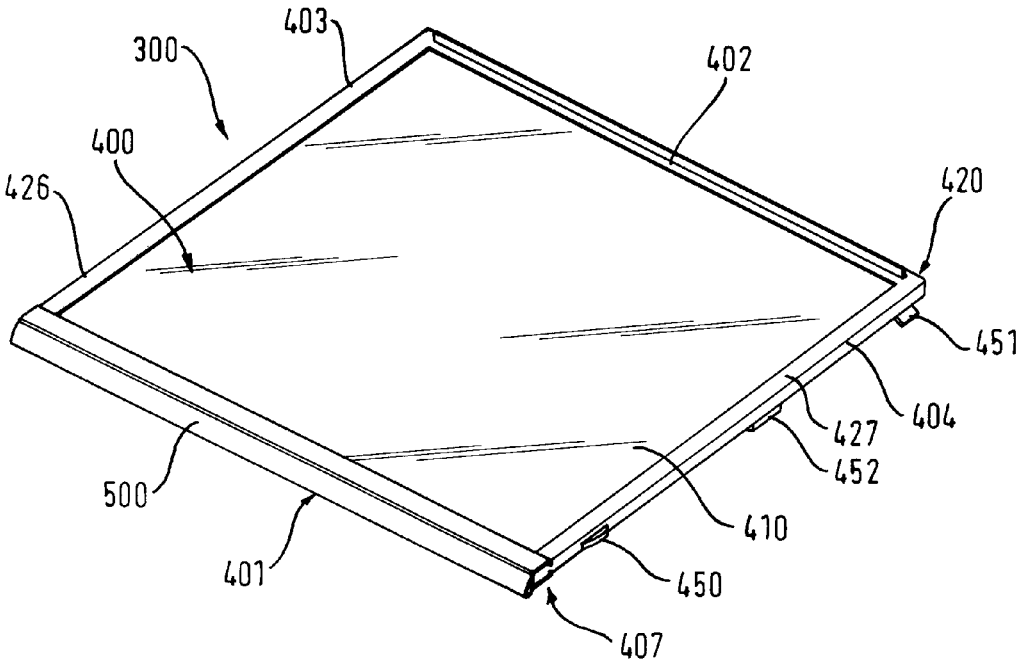
FIG. 3 shows a first exemplary embodiment of a storage shelf constructed according to the invention, having a shelf element and a profiled strip which may be mounted thereon.

FIG. 3 shows a first advantageous exemplary embodiment 300 of a storage shelf constructed according to the invention, having a panel 410, an edge strip or framing element 420 which surrounds the panel 410, and a profiled strip 500 which is arranged on the end face of the shelf element 400. The edge strip 420 takes the form for example of an injection molded strip which completely surrounds the glass panel 410.

The portion 427 of the edge strip 420 which runs depthwise on the right-hand side 404 of the shelf element 400 has three holding elements 450, 451, 452 which serve to mount the storage shelf 300 inside the refrigeration space 200. The holding elements 450, 451, 452, which are illustrated here only by way of example, are constructed to cooperate with the side walls 210, 220 of the refrigeration space 200 and/or the holding means arranged thereon. Corresponding holding means, which are however not visible in the perspective illustration, are also constructed on the portion 426 of the edge strip 420 which runs along the left-hand edge side 403 of the shelf element 400 and extends depthwise.

The profiled strip 500 which is arranged along the front of the edge portion 401 of the shelf element 400—that is, along the front end face thereof—takes the form of a clip and reaches at least around a front part 424 of the edge strip 420 in a corner region 407 of the shelf element 400.

Figure 4:
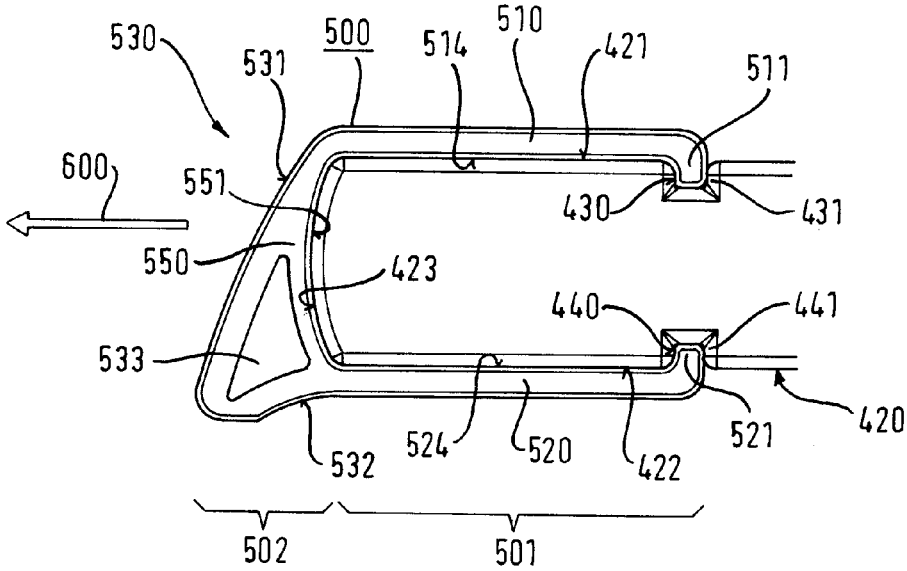
FIG. 4 shows a side view of the storage shelf from FIG. 3.

FIG. 4 illustrates in detail how the profiled strip 500 is fastened to the edge strip 420, and shows a lateral profile view of the edge element 420 and the profiled strip 500, which reaches around the latter in the end-face edge region 407 of the shelf element 400 in the manner of a clip. The profiled strip includes a holding region 501 which serves for mounting the profiled strip 500 on the edge strip 420, and adjoining this a profile region 502 whereof the shape is adapted to the respective applications. The holding region 501 substantially comprises two mutually parallel limbs 510, 520 which are connected to one another by way of a connection web 550. Together with the web 550, the two limbs 510, 520 form a clip-shaped structure which allows the edge strip 420 to be surrounded on both sides. In this arrangement, the upper limb 510 lies with a lower bearing surface 514 on a region of the upper side 421 of the edge strip 420. In a similar manner, the lower limb 520 lies with an upper bearing surface 524 against a lower side 422 of the edge strip 420.

To make a releasable connection between the profiled strip 500, which is mounted on the front end side of the shelf element 400, and the edge strip or framing element 420, the free ends of the two limbs 510, 520 are provided with inwardly directed projections 511, 521 which engage in a respective groove 431, 441 made in the upper and lower sides 421, 422 of the edge strip 420. In this arrangement, the respective groove runs substantially parallel to the front end edge of the front edge strip portion 424, across the transverse width of the respective side edge strip portion 426, 427 that extends depthwise. As seen in the direction of depth, it is longitudinally spaced from the front end edge of the front edge strip portion 424 by an amount that substantially corresponds to the depthwise width thereof. Thus, it is provided in the front corner region of the framing element 420. In this arrangement, the downwardly directed projection 511 of the upper limb 510 reaches behind a front shouldered edge 430 of the upper groove 431, while the upwardly directed projection 521 of the lower limb 520 reaches behind the end-face shouldered edge 440 of the lower groove 441. This has the result of creating a mechanical connection between the profiled strip 500 and the edge strip 420 which prevents the profiled strip 500 from being withdrawn forwardly at the front from the edge strip 420 in the direction 600.

As shown in FIG. 4, in the mounted condition of the profiled strip 500 the outer face 551 of the connection web 500 lies against the end face 423 of the edge strip 420, which in the present example has a rounded profile. By adapting the contours of the contact regions of the two strips 500, 420 to have a close fit, optimum seating of the profiled strip 500 on this edge strip 420 can be achieved.

The profile region 502 of the profiled strip 500 has a gripping structure 530 which is shaped in the form of a lug and has a first front side 530, serving as a face plate, and a second, lower side 532 which makes it possible to reach behind it. In the present exemplary embodiment, and as seen in cross-section and in side view, the gripping structure 530 has a substantially triangular aperture or hollow chamber 533. The structure 533 may also take the form of a lateral, hollow-like recess which may serve as a lateral grip, for example during mounting of the profiled strip 500.

Figure 5:
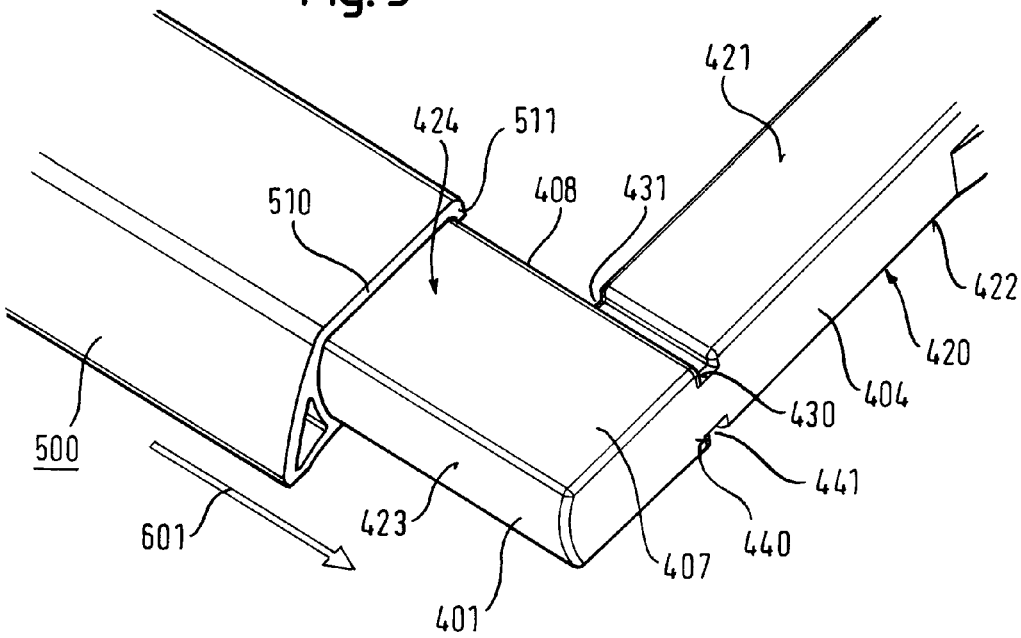
FIG. 5 shows a perspective illustration of the components from FIG. 4, in a partially mounted condition.

The front end-face profiled strip 500 may be mounted on the shelf element 400 by being laterally slid or pulled onto the front end-face edge strip portion 424, during which the grooves 431, 441 serve as respective guides for the projections 511, 521. FIG. 5 shows a corresponding illustration of the procedure of mounting the profiled strip 500. In the partially mounted condition, the profiled strip 500 surrounds the front end-face portion 424 of the edge strip 420 by means of both limbs 510, 520, wherein the two projections 511, 521 each reach behind an edge 408 of the end-face portion 424 of the edge strip 420. As a result, guidance during mounting of the profiled strip 500 is ensured. If the profiled strip 500 extends over the entire width of the shelf element 400, in the course of mounting the profiled strip 500 is slid further in the direction 601 indicated by the arrow until it terminates flush with the right-hand and left-hand outer face of the edge strip 420 and the projections 511, 521 on the limbs 510, 520 engage in or latch into the grooves 431, 441.

Figure 6:
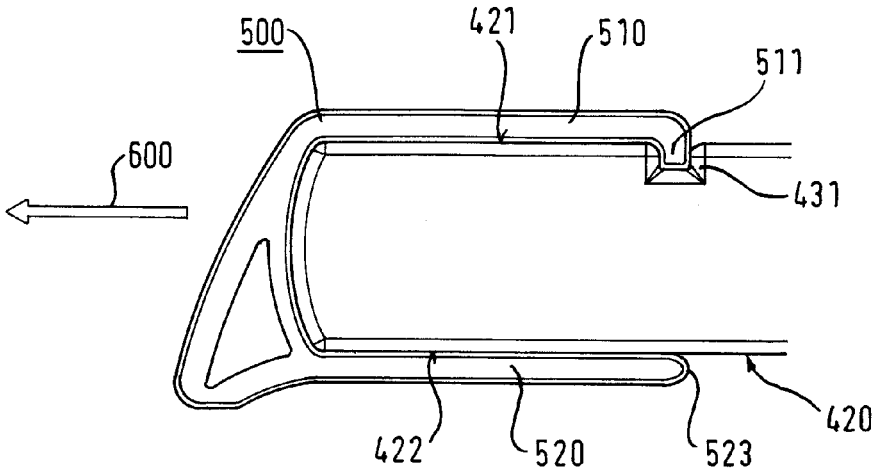
FIG. 6 shows a side view of a storage shelf which is modified by comparison with FIGS. 3 to 5, having a profiled strip which surrounds the edge strip and has a means of reaching behind the edge strip on only one side.
Figure 7:
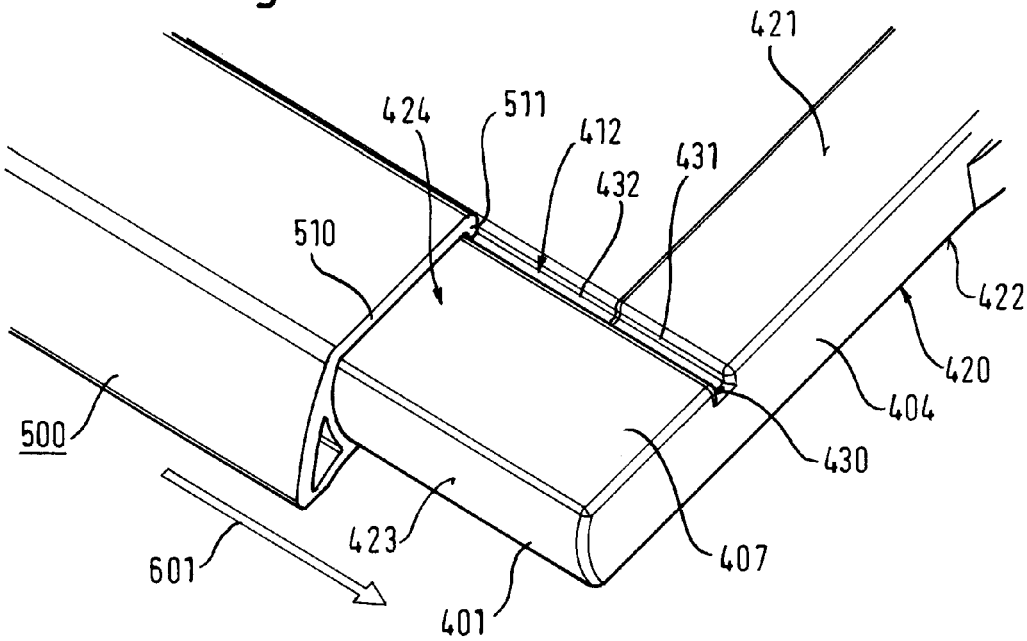
FIG. 7 shows a perspective illustration of the components from FIG. 6, in a partially mounted condition.

Depending on the application, it may in some cases be sufficient if the profiled strip 500 is coupled to the edge strip 420 by way of a form-fitting connection arranged only on one side. FIG. 6 shows, by way of an example of this, a profiled strip 500 in which only the upper limb 510 has a corresponding projection 511 engaging in a groove 431 made on the upper side 421 of the edge strip 420. By contrast, the lower limb 520 terminates in a straight end 523. As illustrated in FIG. 7, the profiled strip 500 shown in FIG. 6 is also mounted by sliding the profiled strip 500 laterally onto a front end-face portion 424 of the frame strip 420. The lateral sliding on of the profiled strip 500 is indicated by an arrow 601. In this arrangement, as shown by way of example in FIG. 7, the panel 410 may also itself have a shouldered edge 412, in particular a groove, which during mounting and/or in the mounted condition of the profiled strip 500 cooperates with a projection 511 arranged on one of the limbs 510, 520 of the profiled strip 500 such that the respective projection 511 reaches behind the shouldered edge 412, with the result that a substantially form-fitting connection is made between the front end-face profiled strip 500 and the panel 410.

Figure 8:
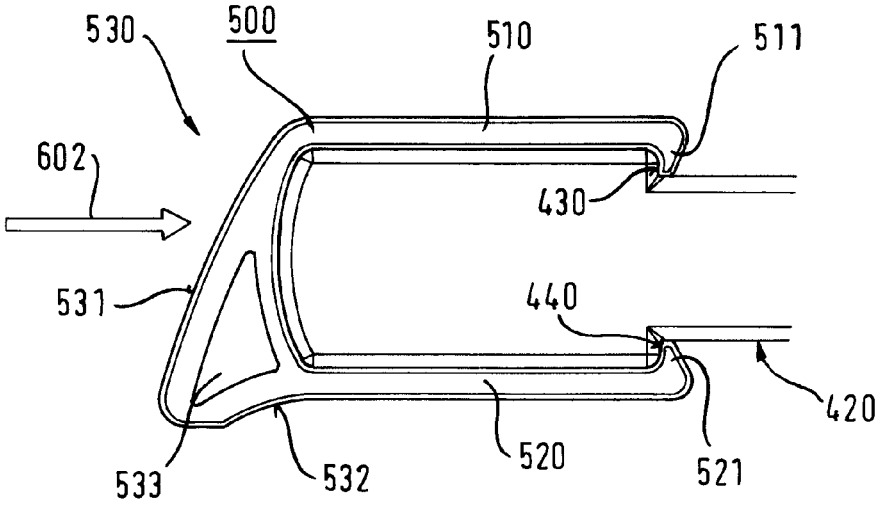
FIG. 8 shows a side view of a further advantageous exemplary embodiment of a storage shelf constructed according to the invention, having a profiled strip which is secured to the edge strip by means of latching elements.

FIG. 8 shows a further advantageous possibility of fastening the profiled strip 500 to the edge strip 420. In this arrangement, the two projections 511, 512 take the form of latching elements which, when the profiled strip 500 is slid onto the front edge strip portion 424 of the edge strip 420 in the mounting direction, shown by an arrow 602 pointing depthwise, reach behind the upper and lower shouldered edges 430, 440 of the edge strip 420 in the limit position of the profiled strip 500. In this arrangement, during mounting the two latching elements 511, 521 first result in a spreading, that is to say an outward deflection, of at least one of the two limbs 510, 520 and, when a limit position is reached, respectively come into snap-on or latching engagement with a shouldered edge arranged on the respective side such that a form-fitting connection is made between the profiled strip 500 and the edge strip 420. In other words, with this variant embodiment the profiled strip is pressed depthwise onto the front edge strip portion 424 and remains seated thereon as the result of a snap-on, push-on and/or clamping connection.

Figure 9:
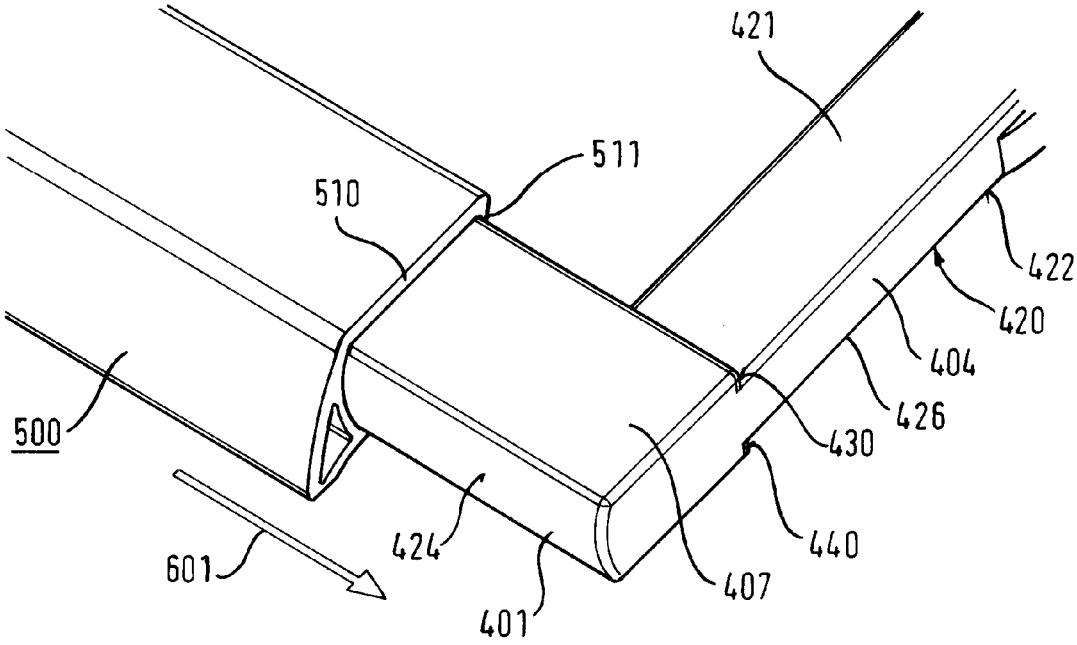
FIG. 9 shows a perspective illustration of the components from FIG. 8, in a partially mounted condition.

As can be seen from FIG. 9, the profiled strip 500 having latch-type projections 511, 521 may, however, also be mounted by being slid on laterally in the direction 601, in the manner already known from FIGS. 5 and 7.

Figure 10:
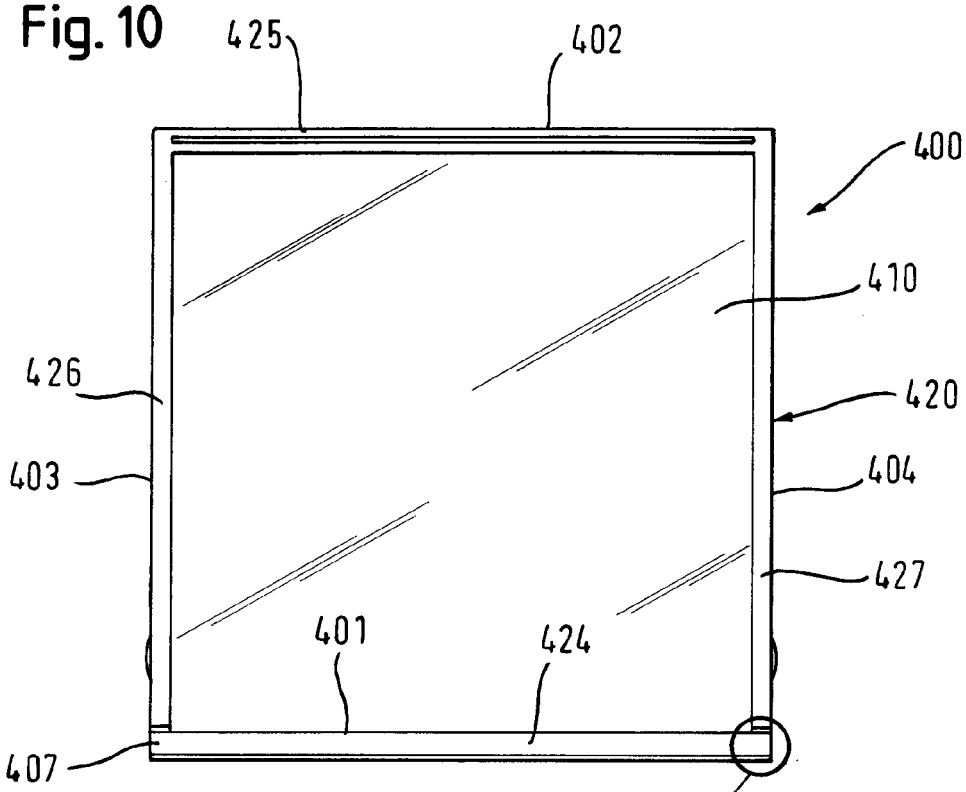
FIG. 10 shows a plan view of a shelf element for an advantageous exemplary embodiment of a storage shelf constructed according to the invention, wherein the shelf element has a panel and an edge strip, the latter completely surrounding the panel.

FIG. 10 shows, schematically and in plan view, a shelf element 400 for the respective storage shelf 300. The shelf element 400 includes a panel 410, which preferably takes the form of a rectangular glass panel, and an edge strip or framing element 420 which extends along the outer periphery of the panel 410. The edge strip 420 has four substantially rectilinear portions 424, 425, 426, 427 which completely frame the panel 410. The edge strip portion 424 that forms the front end-face or door-face edge portion 401 of the shelf element 400 forms the front end-face edge region 407 of the shelf element 400 on which the profiled strip 500 is mounted.

Figure 11:
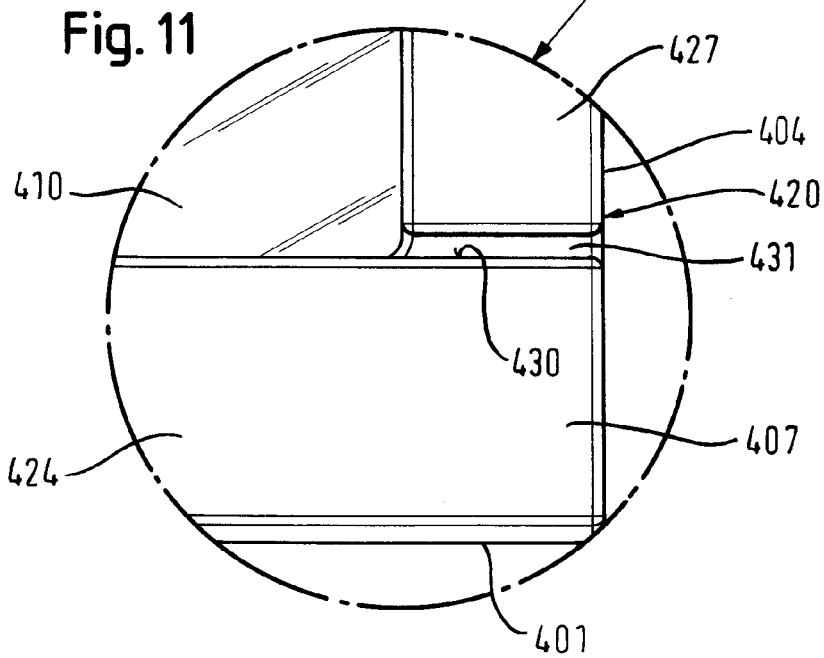
FIG. 11 shows a detailed view of the shelf element from FIG. 10.

FIG. 11 shows the portion marked by a circle in FIG. 10, in a detailed illustration. According to this, the frame or edge strip 420 has a shouldered edge 430 which terminates flush with the rear edge of the end-face edge strip portion 424. This shouldered edge 430 is formed by an end-face step of a groove 431 which serves to guide the profiled element 500 or to be reached behind during mounting.

Figure 12:
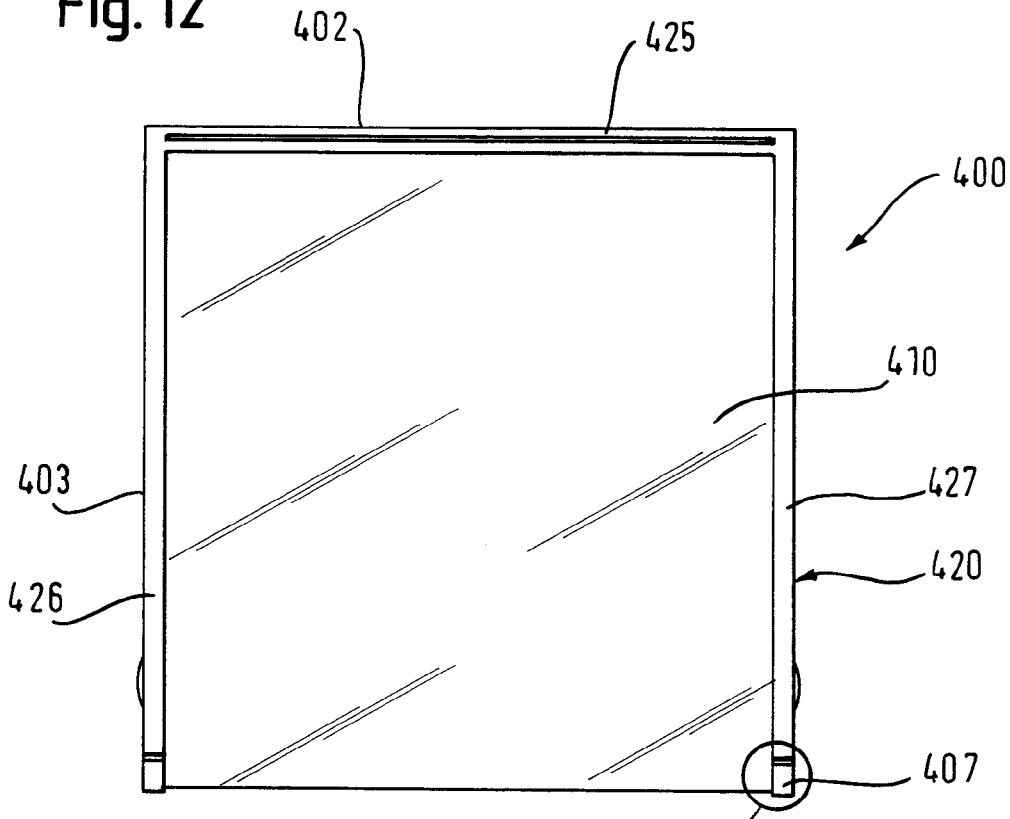
FIG. 12 shows a plan view of a shelf element for an advantageous exemplary embodiment of a storage shelf constructed according to the invention, wherein the shelf element is pushed into a frame formed by the edge strip.

FIG. 12 shows a further advantageous embodiment of the shelf element 400 for the storage shelf 300. In this arrangement, the panel 410 is not completely surrounded by the edge strip 420. The lack of a front end-face edge strip portion 424 means that the shelf element 400 can be assembled in a simple manner, the glass panel 410 being slid into the frame formed by the three portions 425, 426, 427 of the edge strip. The profiled strip 500 is mounted in a manner similar to the embodiment shown for example from FIG. 5, by sliding the profiled strip on laterally. In this arrangement, if the glass panel 410 is merely pushed into the frame formed by the edge strip 420, the profiled strip 500 may have the effect of fixing the glass panel 410 inside the frame.

Figure 13:
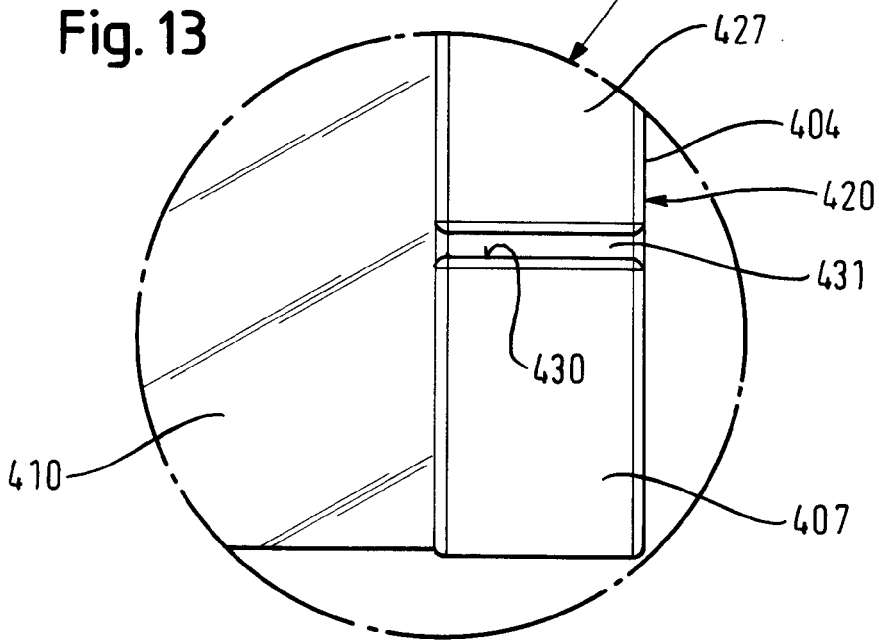
FIG. 13 is a detailed view of the shelf element from FIG. 12.

FIG. 13 shows the region of the shelf element 400 marked by a circle in FIG. 12, in a detailed illustration. In this arrangement it is clear that a groove 431 is formed inside the right-hand edge strip portion 427 and the end-face shouldered edge 430 thereof serves to be reached behind by the projection on the upper limb 510 of the profiled strip 500.

Figure 14:
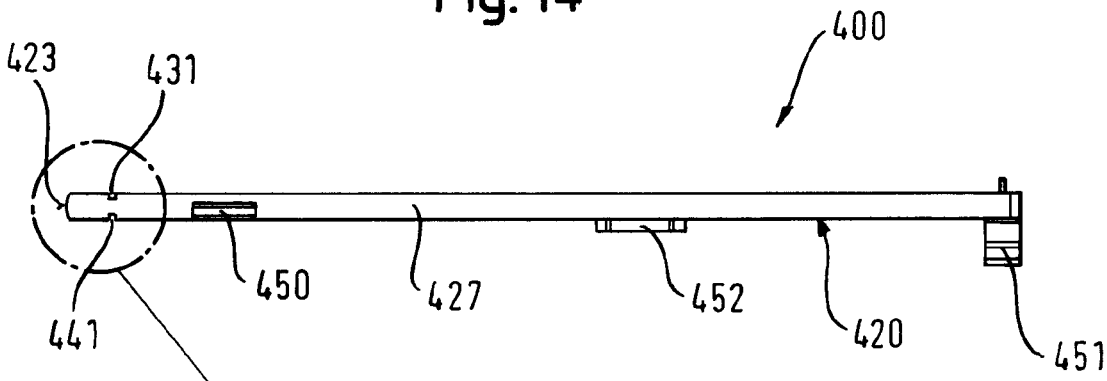
FIG. 14 is a side view of the shelf element from FIG. 12.

FIG. 14 shows the shelf element 400 in a side profile illustration. In this arrangement, it is clear that three holding elements 450, 451, 452 are arranged on the right-hand edge strip portion 427 and serve to mount the storage shelf in the interior 200 of the refrigeration device 100. The left-hand edge strip portion 426 is constructed correspondingly.

Figure 15:
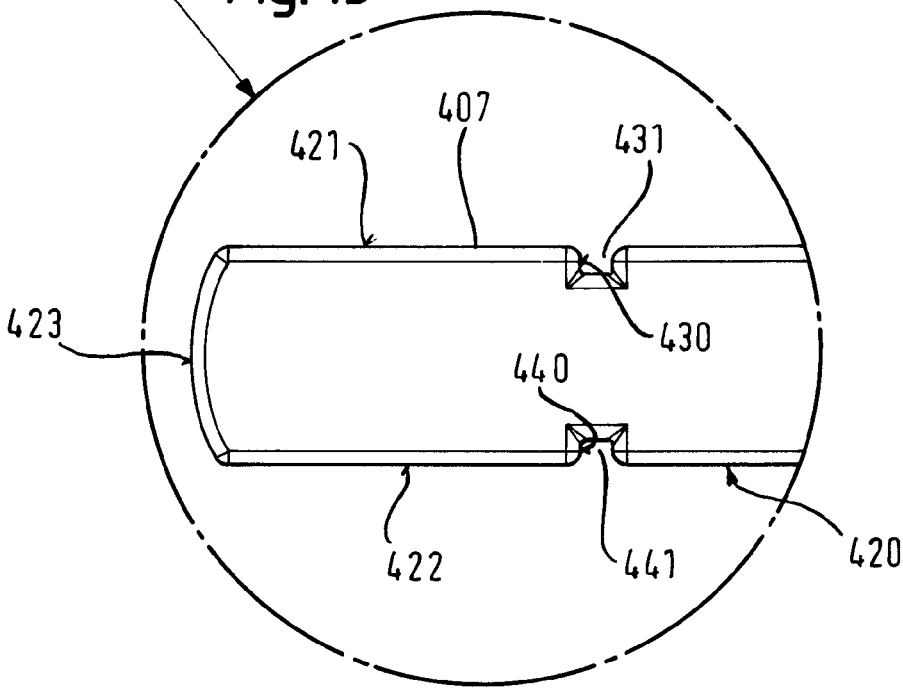
FIG. 15 is a detailed view of the shelf element from FIG. 14.

FIG. 15 shows a detailed view of the region marked by a circle in FIG. 14, the right-hand portion 427 of the edge strip 420. The edge strip 420 has two grooves 431, 441 which are arranged symmetrically in relation to one another, at the same depthwise spacing from the end face 423 of the of the edge strip 420, on the upper side 421 and the lower side 422 of the edge strip 420. In the present exemplary embodiment, the two grooves 431, 441 have a slight rounding in order to make it easier for example to introduce the two projections 511, 521 of the profiled strip 500 into the associated grooves 431, 441 laterally. Further, the entire edge strip 420 may have beveled or rounded edges, which can serve to improve handling, feel or incorporation of the storage shelf 400 in the refrigeration space 200.

Figure 16:
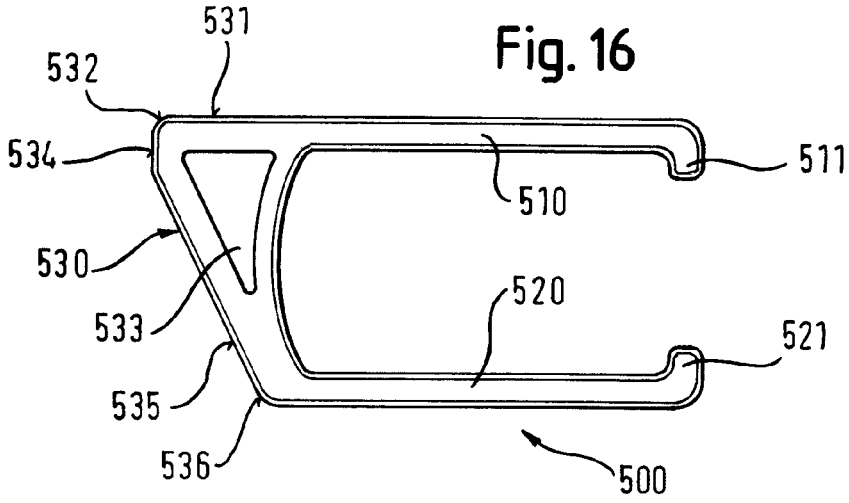
FIG. 16 is a side view of a further, modified profiled strip having a lug which terminates flush with its upper limb.
Figure 17:
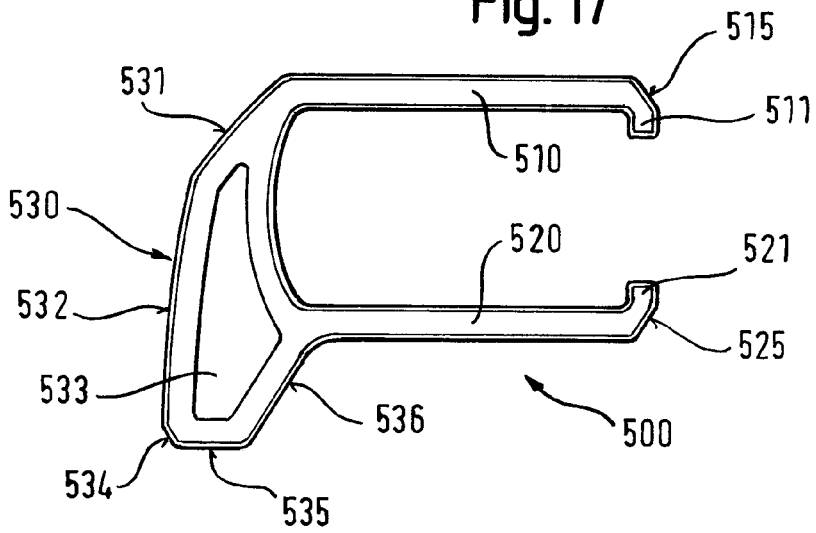
FIG. 17 is a side view of a profiled strip having a further, modified downwardly bent lug.
Figure 18:
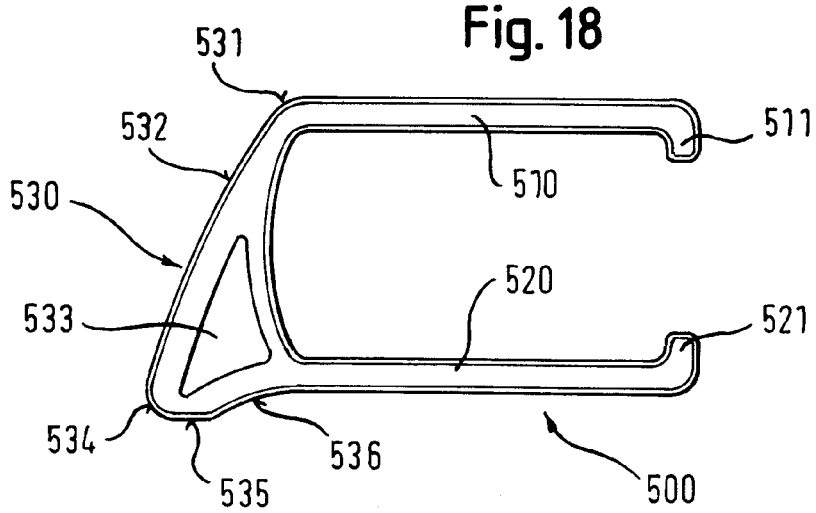
FIG. 18 is a side view of a further, modified profiled strip having a downwardly bent lug.

Depending on the application, the end-face profiled strip 500 may have different constructions. FIGS. 16 to 18 below show by way of example profile illustrations of three different profiled strips 500.

The profiled strip 500 in FIG. 16 shows, in addition to the limbs 510, 520 with the inwardly directed projections 511, 521, which have already been described, a substantially triangular profile structure 530 having a substantially triangular aperture 533. The profile of this structure 530 includes five successive surface segments 531, 532, 534, 535, 536, wherein the first surface segment 531 terminates flush with the upper surface of the upper limb 510. The rounded second surface segment 531 connects the first surface segment 531 to the substantially perpendicular third surface segment 534. The fourth surface segment 535 adjoining this represents an oblique portion of the profiled strip 500 which makes possible for example a better view of the refrigerated goods arranged in the refrigeration space 200 of the refrigeration device 100. Finally, the rounded fifth surface segment 536 connects the fourth surface segment 535 to the lower surface of the lower limb 520.

FIG. 17 shows a further profiled strip 500 having a profile structure 530 constructed in the manner of a grip. The profile of this profile structure also includes five successive surface segments. In this arrangement, the first surface segment 531 includes an oblique part which may for example serve as a bearing surface for the thumb. The oblique part 531 is constructed to be at approximately 45° to the substantially horizontal upper limb 510. The second portion 532 adjoining it forms a further oblique part which, by way of a short surface segment 534 forming an oblique portion and a substantially horizontal surface segment 535, opens into an upwardly oblique fifth surface segment 536. The fifth surface segment 536 serves for example as a bearing surface for the index, middle and/or ring finger. It projects downwards in relation to the lower side of the lower limb 520 by a desired length, with the result that an engagement hollow or rear recess is formed.

A further advantageous feature of the edge strip 500 shown by way of example in FIG. 17 is presented by oblique edges 515, 525 which are respectively formed between the horizontal limbs 510, 520 and the associated, substantially vertical projection 511, 521. These chamfers avoid sharp edges and corners which could for example make it harder to clean the shelf element.

Finally, FIG. 18 shows a further profiled strip 500 having a profile structure 530 constructed in the manner of a grip. The profile of the profile structure 530 substantially includes five surface segments 531, 532, 534, 535, 536. In this arrangement, a rounded surface segment 531 connects the upper surface of the upper limb 510 to a slightly convexly rounded long surface segment 532 which runs obliquely downwards at approximately 70° in relation to the upper limb 510 and serves for example as a bearing for the thumb. A rounded surface segment 534 adjoining it connects the long surface segment 532 to a substantially horizontal fourth surface segment 535 and, adjoining this, a slightly concavely rounded fifth segment 536 which runs obliquely upwards at an angle of approximately 15°. The fifth segment 536 may in this arrangement serve as a bearing surface for the index, middle and/or ring finger and projects in relation to the lower side of the lower limb 520 by a predeterminable length.

The embodiments which have been explained with reference to the figures are preferred embodiments of the invention. In addition, further embodiments may be realized that include further modifications of the invention. In particular, instead of the exemplary embodiments of the projections and grooves which have been shown here, other structures having the same mutual interaction may also be used. The strips illustrated here should be regarded merely as possible embodiments which may be replaced by strips of different shape. For example, it is conceivable to provide a profiled strip with an upwardly extending profile structure which may serve to prevent the refrigerated goods from falling.

LIST OF REFERENCE NUMERALS

100 Refrigeration device
110 Housing
111 Housing opening
120 Door
121 Door inner wall
200 Interior space
201 First compartment
202 Second compartment
210 First side wall of interior space
211-213 Holding means
220 Second side wall of interior space
230 Rear wall of interior space
300 Storage shelf
400 Shelf element
401 End-face edge portion of shelf element
402 Rear edge portion of shelf element
403 Left-hand edge portion of shelf element
404 Right-hand edge portion of shelf element
405 Upper side of shelf element
406 Lower side of shelf element
407 End-face edge region of shelf element
408 Edge of end-face portion of edge strip
410 Panel
412 Shouldered edge/ridge in the panel
420 Edge strip
421 Upper side of edge strip
422 Lower side of edge strip
423 End face of edge strip
424 End-face portion of edge strip
425 Rear portion of edge strip
426 Left-hand portion of edge strip
427 Right-hand portion of edge strip
430 First shouldered edge
431 First groove in the edge strip
432 Groove in the panel
440 Second shouldered edge
441 Second groove in the edge strip
450-453 Holding elements in the edge strip
460 Rear edge strip
470 Left-hand edge strip
500 Profiled strip
501 Holding region
502 Profile region
510 Upper limb of profiled strip
511 Projection in upper limb of profiled strip
512 Oblique surface of upper projection/latching element
514 Bearing surface of upper limb
515 Chamfer on upper limb
520 Lower limb of profiled strip
521 Projection in lower limb of profiled strip
522 Oblique surface of lower projection/latching element
523 Straight end of lower limb
524 Bearing surface of lower limb
525 Chamfer of lower limb
530 Profile structure
531 First side of profile structure
532 Second side of profile structure
533 Aperture/hollow chamber
540 Bearing edge
550 Connection web
551 Bearing surface of connection web
600 Direction of withdrawal of storage shelf
601 Direction of mounting profiled strip
602 Direction of latching in
AG External housing

The invention claimed is:

1. A refrigeration device, comprising:

at least one internal container having at least one storage shelf, the storage shelf having a front edge, a rear edge and side edges connecting the front and rear edges;

an edge strip or framing element having at least a side edge portion attached along at least one of the side edges of the storage shelf, said side edge portion including a front corner region said side edge portion including at least one shouldered edge in at least the front corner region and extending in a direction parallel to the front edge of the storage shelf; and at least one outer profiled strip extending along part of or all of the front corner region, by at least one connection selected from a group consisting of a snap-on connection, a push-on connection, a clamping connection, and a lateral slide-on connection in which a part of the at least one outer profiled strip releasably engages the at least one shouldered edge of the side edge portion of the edge strip or framing element; wherein the profiled strip is seated on the edge strip or framing element and has upper and lower limbs, wherein, in a mounted condition of the profiled strip, the edge strip or framing element is surrounded on an upper side by the upper limb of the profiled strip and on a lower side by the lower limb of the profiled strip.

2. The refrigeration device of claim 1, wherein the refrigeration device is a household refrigerator.

3. The refrigeration device of claim 1, wherein the storage shelf includes a shelf element having a panel which defines the front edge, said edge strip or framing element being provided along part of or all of the front edge of the panel.

4. The refrigeration device of claim 3, wherein the panel is a glass panel.

5. The refrigeration device of claim 3, wherein the edge strip or framing element is provided around an outer periphery of the panel.

6. The refrigeration device of claim 3, wherein the panel is enclosed by the edge strip or framing element.

7. The refrigeration device of claim 3, wherein the shelf element has two longitudinal side edges extending in a direction of depth, and each said side edge portion having a groove that runs across an entire transverse width of a front region of each side edge portion, a front region of each side edge portion forming the front corner region of the storage shelf.

8. The refrigeration device of claim 3, wherein the panel has at least one shouldered edge which, in the mounted condition of the profiled strip, cooperates with at least one projection arranged on at least one of the upper and lower limbs of the profiled strip such that the projection reaches behind the shouldered edge of the panel to establish a form-fitting connection selected from the group consisting of a snap-on connection, a push-on connection, a clamping connection, and a lateral slide-on connection between the profiled strip and the panel.

9. The refrigeration device of claim 3, wherein the edge strip or framing element is an injection molded strip which at least partly surrounds the panel.

10. The refrigeration device of claim 1, wherein the storage shelf includes a shelf element having a panel which defines the front edge, said shouldered edge being provided at least on one member selected from the group consisting of the upper side and lower side of the edge strip or framing element, wherein the at least one shouldered edge, in the mounted condition of the profiled strip, cooperates with a projection on the profiled strip such that the projection reaches behind the shouldered edge to establish a form-fitting connection selected from the group consisting of the snap-on connection, the push-on connection, the clamping connection, and the lateral slide-on connection between the profiled strip and the shelf element.

11. The refrigeration device of claim 10, wherein the shouldered edge is a groove extending in the direction parallel to the front edge of the storage shelf.

12. The refrigeration device of claim 10, wherein the shouldered edge serves as a guide for the projection, said profiled strip being constructed for mounting on the shelf element by being slid laterally in the direction parallel to the front edge of the storage shelf.

13. The refrigeration device of claim 10, wherein the edge strip or framing element has a front edge strip portion which, in the mounted condition of the profiled strip, is surrounded by the upper and lower limbs of the profiled strip, and the side edges adjoin ends of the front edge strip portion and extend in a direction of depth.

14. The refrigeration device of claim 13, wherein the shouldered edge is formed by a difference in thickness between the front edge strip portion and each said side edge portion.

15. The refrigeration device of claim 10, wherein the projection is a latching element which causes the upper and lower limbs of the profiled strip to spread when the profiled strip is mounted on the shelf element and comes into snap-on engagement with the shouldered edge when a limit position is reached.

16. The refrigeration device of claim 1, wherein the upper and lower limbs of the profiled strip extend substantially parallel to one another and to a front edge strip portion of the edge strip or framing element and form between the upper and lower limbs of the profiled strip a holding region which is adjacent to a front profiled region of the profiled strip, wherein the front profiled region includes a profile structure in the form of a grip and/or a face plate.

17. The refrigeration device of claim 16, wherein the profile structure is a lug having a substantially triangular profile.

18. The refrigeration device of claim 17, wherein the lug has an essentially triangular aperture extending along the profiled strip.

19. The refrigeration device of claim 17, wherein the lug is formed offset downwards in relation to the upper and lower limbs.

20. The refrigeration device of claim 1, wherein the edge strip or framing element includes one or more holding elements adapted to mount the storage shelf on side walls of the internal container.

21. A storage shelf assembly for a refrigeration device, comprising:

a storage shelf having a first edge, a rear edge and side edges extending between the front and rear edges;

an edge strip or framing element having at least a side edge portion attached along at least one of the side edges of the storage shelf, said side edge portion defining a front corner region, said side edge portion including at least one shouldered edge in at least the front corner region and extending in a direction parallel to the front edge of the storage shelf; and at least one outer profiled strip extending along part of or all of a longitudinal extent of the front corner region, by at least one connection selected from a group consisting of a snap-on connection, a push-on connection, a clamping connection, and a lateral slide-on connection in which a part of the at least one outer profiled strip releasably engages the at least one shouldered edge of the side edge portion of the edge strip or framing element; wherein the profiled strip is seated on the edge strip or framing element and has upper and lower limbs, wherein, in the mounted condition of the profiled strip, the edge strip or framing element is surrounded on an upper side by the upper limb of the profiled strip and on a lower side by the lower limb of the profiled strip.

22. The storage shelf assembly of claim 21, further comprising a shelf element having a panel which defines the front edge, said edge strip or framing element being provided along part of or all of the front edge of the panel.

23. The storage shelf assembly of claim 22, wherein the panel is a glass panel.

24. The storage shelf assembly of claim 22, wherein the edge strip or framing element is provided around an outer periphery of the panel.

25. The storage shelf assembly of claim 22, wherein the panel is enclosed by the edge strip or framing element.

26. The storage shelf assembly of claim 22, wherein the shelf element has two longitudinal side edges extending in a direction of depth, each said side edge portion having a groove that runs across an entire transverse width of a front region of each side edge portion, the front region of each side edge portion forming the front corner region of the storage shelf.

27. The storage shelf assembly of claim 22, wherein the panel has at least one shouldered edge which in the mounted condition of the profiled strip cooperates with at least one projection arranged on at least one of the upper and lower limbs of the profiled strip such that the projection reaches behind the shouldered edge of the panel to establish a form-fitting connection selected from the group consisting of a snap-on connection, a push-on connection, a clamping connection, and a lateral slide-on connection between the profiled strip and the panel.

28. The storage shelf assembly of claim 22, wherein the edge strip or framing element is an injection molded strip which at least partly surrounds the panel.

29. The storage shelf assembly of claim 21, further comprising a shelf element having a panel which defines the front edge, wherein the shouldered edge is provided at least on one member selected from the group consisting of the upper side and lower side of the edge strip or framing element, wherein the at least one shouldered edge, in the mounted condition of the profiled strip, cooperates with a projection on the profiled strip such that the projection reaches behind the shouldered edge to establish a form-fitting connection selected from the group consisting of the snap-on connection, the push-on connection, the clamping connection, and the lateral slide-on connection between the profiled strip and the shelf element.

30. The storage shelf assembly of claim 29, wherein the shouldered edge is a groove extending in the direction parallel to the front end fledge of the storage shelf.

31. The storage shelf assembly of claim 29, wherein the shouldered edge serves as a guide for the projection, said profiled strip being constructed for mounting on the shelf element by being slid laterally in the direction parallel to the front edge of the storage shelf.

32. The storage shelf assembly of claim 29, wherein the edge strip or framing element has a front edge strip portion which, in the mounted condition of the profiled strip, is surrounded by the upper and lower limbs of the profiled strip, and the side edges adjoin ends of the front edge strip portion and extend in a direction of depth.

33. The storage shelf assembly of claim 32, wherein the shouldered edge is formed by a difference in thickness between the front edge strip portion and each said side edge portion.

34. The storage shelf assembly of claim 29, wherein the projection is a latching element which causes the upper and lower limbs of the profiled strip to spread when the profiled strip is mounted on the shelf element and comes into snap-on engagement with the shouldered edge when a limit position is reached.

35. The storage shelf assembly of claim 21, wherein the upper and lower limbs of the profiled strip extend substantially parallel to one another and to a front edge strip portion of the edge strip or framing element and form between the upper and lower limbs of the profiled strip a holding region which is adjacent to a front profiled region of the profiled strip, wherein the front profiled region includes a profile structure in the form of a grip and/or a face plate.

36. The storage shelf assembly of claim 35, wherein the profile structure is a lug having a substantially triangular profile.

37. The storage shelf assembly of claim 36, wherein the lug has an essentially triangular aperture extending along the profiled strip.

38. The storage shelf assembly of claim 36, wherein the lug is formed offset downwards in relation to the upper and lower limbs.

39. The storage shelf assembly of claim 21, wherein the edge strip or framing element includes one or more holding elements adapted to mount the storage shelf on side walls of an internal container.

* * * * *